US006079630A

United States Patent [19]

Schroeder

[11] Patent Number: 6,079,630

[45] Date of Patent: Jun. 27, 2000

[54] RAILWAY GRADE CROSSING APPARATUS AND METHOD OF INSTALLATION

[76] Inventor: Rick A. Schroeder, 141 S. Aberdeen St., Gretna, Nebr. 68028

[21] Appl. No.: 09/058,672

[22] Filed: Apr. 10, 1998

Related U.S. Application Data

[60] Provisional application No. 60/043,479, Apr. 11, 1997.

[51] Int. Cl.[7] ..... E01B 1/00

[52] U.S. Cl. ..... 238/8; 238/2; 238/6; 238/7

[58] Field of Search ..... 238/2, 3, 6, 7, 238/8, 9

[56] References Cited

U.S. PATENT DOCUMENTS

| | | | |
|---|---|---|---|
| 5,181,657 | 1/1993 | Davis | 238/7 |
| 5,813,602 | 9/1998 | Holland | 238/8 |
| 5,899,379 | 5/1999 | Bruyn et al. | 238/8 |

*Primary Examiner*—S. Joseph Morano
*Assistant Examiner*—Robert J. McCarry, Jr.
*Attorney, Agent, or Firm*—Philips J. Lee

[57] ABSTRACT

A railway grade crossing apparatus comprises at least one rectangular gauge panel of precast concrete with resilient bumpers on opposing sides for closely fitting between the rails and rectangular field panels of precast concrete, each having a resilient bumpers on one side for placement between the outside of each rail and the adjacent road abutment, the gauge and field panels having means for attaching lifting a device to the top surface of the panel, and the method of installing said apparatus comprising lifting the panels into place with a bumper abutting the side of a rail, and exerting a lateral force on the panel toward the rail to compress the bumper whereby the opposite side may be urged downward into place and releasing the lateral force to allow the resilience of the compressed bumper to adjust the lateral position of the panel to a final position between the rails or rail and road abutment.

17 Claims, 5 Drawing Sheets

RAILWAY GRADE CROSSING APPARATUS AND METHOD OF INSTALLATION

CROSS REFERENCE TO RELATED PROVISIONAL APPLICATION

This application claims the benefit of U.S. Provisional Application No. 60/043,479, filed Apr. 11, 1997.

BACKGROUND OF THE INVENTION

A. Field of Invention

The present invention relates generally to apparatus for providing for vehicular crossing of railroad grades and the method of installation of said apparatus, and more particularly to a new and improved railroad grade crossing apparatus capable of being quickly and easily installed, and the method of said installation.

B. Description of Related Art

Prior art exists showing means for crossing railway grades that comprising, in general, a variety of devices or methods for filling the spaces between the railway rails and between the rails and the crossing roadway surface, such that a motor vehicle may pass across the railway grade without undo impediment and without suffering unusual disturbance. A further object of the prior art devices is to eliminate the introduction of foreign materials in the gap between the filler devices around the rails and the rails themselves. The prior art devices are generally difficult to install and relatively inefficient in use. The known prior art devices are elastomeric flaps to be attached to the filler slabs that are placed between the rails and between the rails and the road way. The prior art devices are generally difficult to install and relatively inefficient in use. The primary shortcomings of the prior art devices is that they are not easily installed and are not sufficiently laterally resilient to keep the slabs in place and properly centered on the rail bed. The need is therefore felt for an apparatus and method of efficiently providing a railway crossing that is easy to install and that remains securely in place after installation.

SUMMARY OF THE INVENTION

The present invention comprises an improved apparatus providing means for crossing railway grades and the method of installation of such an apparatus. The present invention comprises the use of concrete panels to fill gaps surrounding the railway rails and bring the general level of the surface of the crossing up to the level of the top of the rails. The following description assumes for simplicity the application of the present invention to a two rail railway, without limiting the applicability to multi-rail railways. In the usual nomenclature, the area between the rails is called the gauge, and the rails are assumed to comprise a relatively wide base section, a top section for engaging the rail car wheels, and a web section between the top and base sections, the web being thinner in cross-section than the top or base. The present invention comprises a generally flat, rectangular gauge panel to be placed between the two rails of a two rail railway and generally flat, rectangular field panels to be placed between the end of the crossing road surface and the rails. Accordingly, in a conventional crossing the apparatus would consist of at least two field panels, one on either side, on the outside of the rails and a gauge panel in between the two rails. The panels are formed of concrete, preferably precast concrete, and in a preferred embodiment having a steel frame. The gauge panel has two parallel, rail facing sides, a flat top surface, and a depth appropriately determined by the height of the rails, so as to raise the top surface to a level approximately even with the tops of the rails. While the top surfaces of the gauge and field panels are flat, the bottom surfaces may be contoured to conform to the commonly anticipated or encountered rail bed surfaces. At least two and preferably more cable attachment lugs are embedded in the top surface of the gauge panel and at least one and preferably two such lugs are embedded in the top surface of the field panel, which lugs are all recessed so as to not protrude above the top surfaces. At least two of the cable attachment lugs are laterally spaced toward the rail facing sides. The rail facing sides of the gauge panel are lined with resilient bumpers formed as a hollow extruded rubber bumper and attached to the track facing sides by means of bolt studs and nuts. The gauge panel bumpers are hollow, having a longitudinally extending central cavity surrounded and formed by a top bumper portion, a bottom bumper portion, a track side and a gauge panel mounting side. The field panel bumpers are similarly hollow, having a longitudinally extending central cavity surrounded and formed by a top bumper portion, a bottom bumper portion, a track side and a field panel mounting side. The panel mounting sides of both field and gauge panel bumpers are formed with a number of longitudinally spaced openings that are sized receive the bolt studs and the longitudinal cavities of both field panel bumpers and gauge panel bumpers are large enough to accommodate a nut screwed onto the mounting bolts. Approximate to each such opening, an access opening is formed in the rail side and a portion of the top of the bumper in a size sufficient to receive a nut and nut turning device such as a socket wrench or other similar device. Optionally a stabilizing strap of sheet metal with openings therein at the same intervals as the bolt studs and mounting openings in the bumper is inserted into the bumper cavity through the end opening thereof, such that the mounting bolt studs extend through the mounting side openings of the bumper and then through the stabilizing strap which serves to hold the bumper in place in a stable position when a nut is threaded unto and tightened down on the mounting bolt studs. In both the gauge and field bumpers, the outer surface of the rail side is contoured to closely conform to the side of the rail top portion and the upper section of the rail web. In the preferred embodiment the cross section of the field panel bumper is not identical to the gauge panel bumper, in size and in the top surface. The field panel bumpers generally have a flat upper surface, slightly lower than the surface of the field panel whereas the top surface of the gauge bumper is recessed to allow the wheel flange to pass over the bumper without significantly deforming or damaging the bumper. In addition, the juncture of the top section and the rail side of the gauge panel bumpers forms an upward and outwardly protruding lip that extends to the top of the rail, and the field panel bumpers does not include such a lip. The longitudinal cavity in the field panel bumper is only as large as is needed for the stabilizing strap and mounting nut. The gauge panel bumper in contrast, has a relatively larger internal cavity that provides the gauge bumper with an increased compressibility and flexibility which characteristics are important and useful in the method of installation of the gauge panel as will be described later. The crossing device in general is sized such that the field and gauge bumpers snugly engage the rails to prevent the introduction of debris into the railway bed. Except for the placement of the openings for the mounting bolts and mounting bolt access openings, both field and gauge panel bumpers are uniform in cross section. The field and gauge panel bumpers are formed of an elastomeric substance, preferably styrene butadiene rubber of about 1200 psi tensile and 200% elongation, the gauge panel bumpers having a 50 durometer resiliency and the field panel bumpers having a 60 durometer resiliency.

The preferred installation method of the present invention comprises the installation of the gauge panel between the rails commenced by fastening of a cable harness or other lifting mechanism to the attachment lugs on the top surface of the gauge panel. The gauge panel is hoisted by means of backhoe, crane or other lifting device that has been positioned generally normal to the railway, and the gauge panel is lowered to a point at which the bumper farthest from the lifting device can be engaged under the top section of the rail farthest from the crane. The gauge panel is lowered until the near bumper is resting on the near rail, at which point, the near cables are released. The crane then moves toward, and pulls the gauge panel toward, the distant rail for the purpose of compressing the engaged bumper against the inside of the far rail. The near side of the gauge panel is then urged downward, and with prodding if necessary, the near bumper is urged passed the top section of the near rail into installed position. If the remaining cables are then released, the gauge panel may then shift to equalize the compression of the two bumpers. Alternatively or in addition, the cables may be reattached and the gauge panel may then be lifted with equal tension on all lifting lugs so as to be parallel to the rail bed and releasing the panel from frictional contact with the railway bed such that the equal resilience of the gauge panel bumpers will cause the gauge panel to be equally placed an equal distance from the two rails. Once the gauge panel is placed in the desired position, the lifting device is lowered and the cables are disconnected. A similar method may be used to install the field panels between the road abutment and the outside of the rails. A plurality of field and gauge panels may be used as required to achieve the desired width of crossing. The fully installed invention presents a uniform crossing surface suitable for the passage of vehicles across the railway.

The principal aim of the present invention is to provide a new and improved railway grade crossing apparatus which meets the foregoing requirements and which is capable of being quickly and efficiently installed.

Another and further object and aim of the present invention is to provide a new and improved railway grade crossing apparatus which meets the foregoing requirements and which will be economical to manufacture and assemble.

Yet another and further object and aim of the present invention is to provide a new and improved method of installation of a railway grade crossing apparatus which meets the foregoing requirements and which will be easily and efficiently performed.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
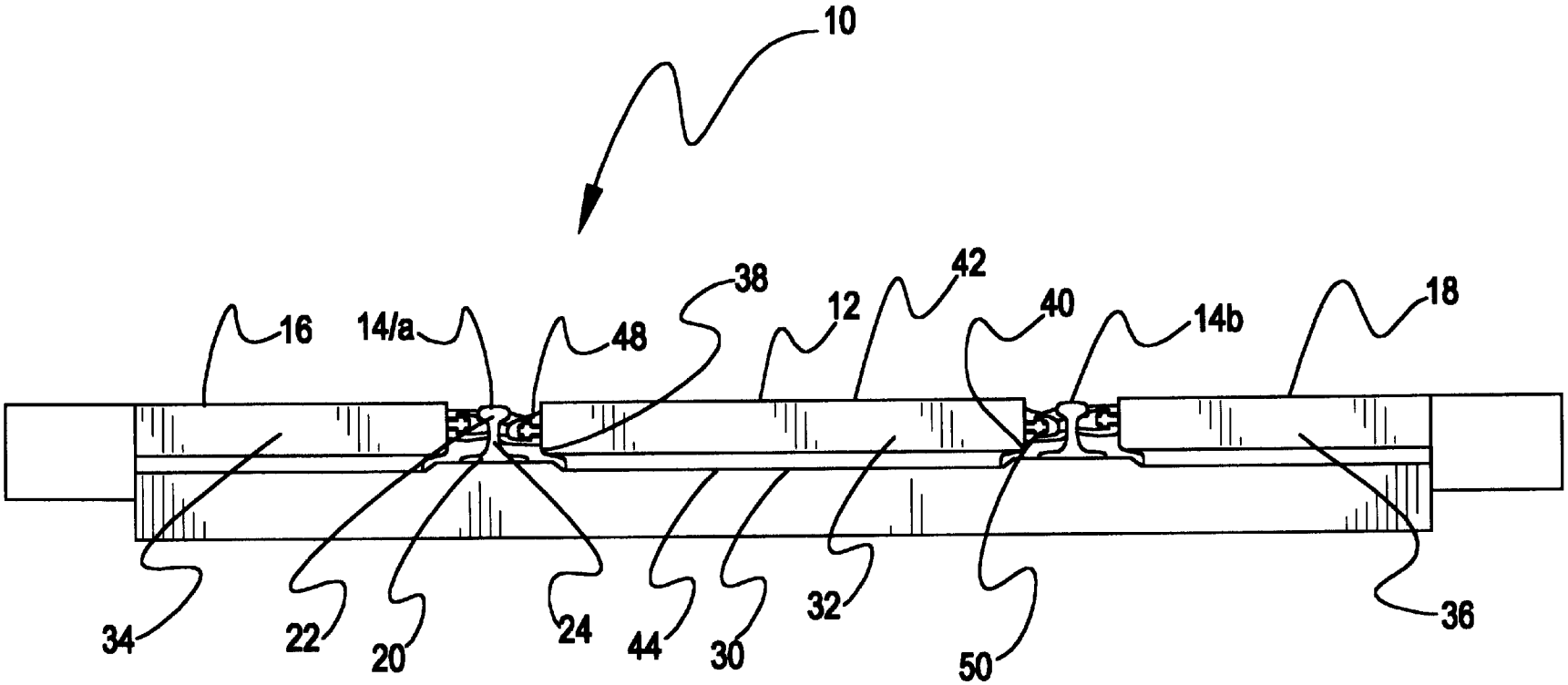
FIG. 1 is a side view of a preferred embodiment of the invention showing the fully installed apparatus in a railway crossing, the rail bed and roadway being shown in section view.
Figure 2:
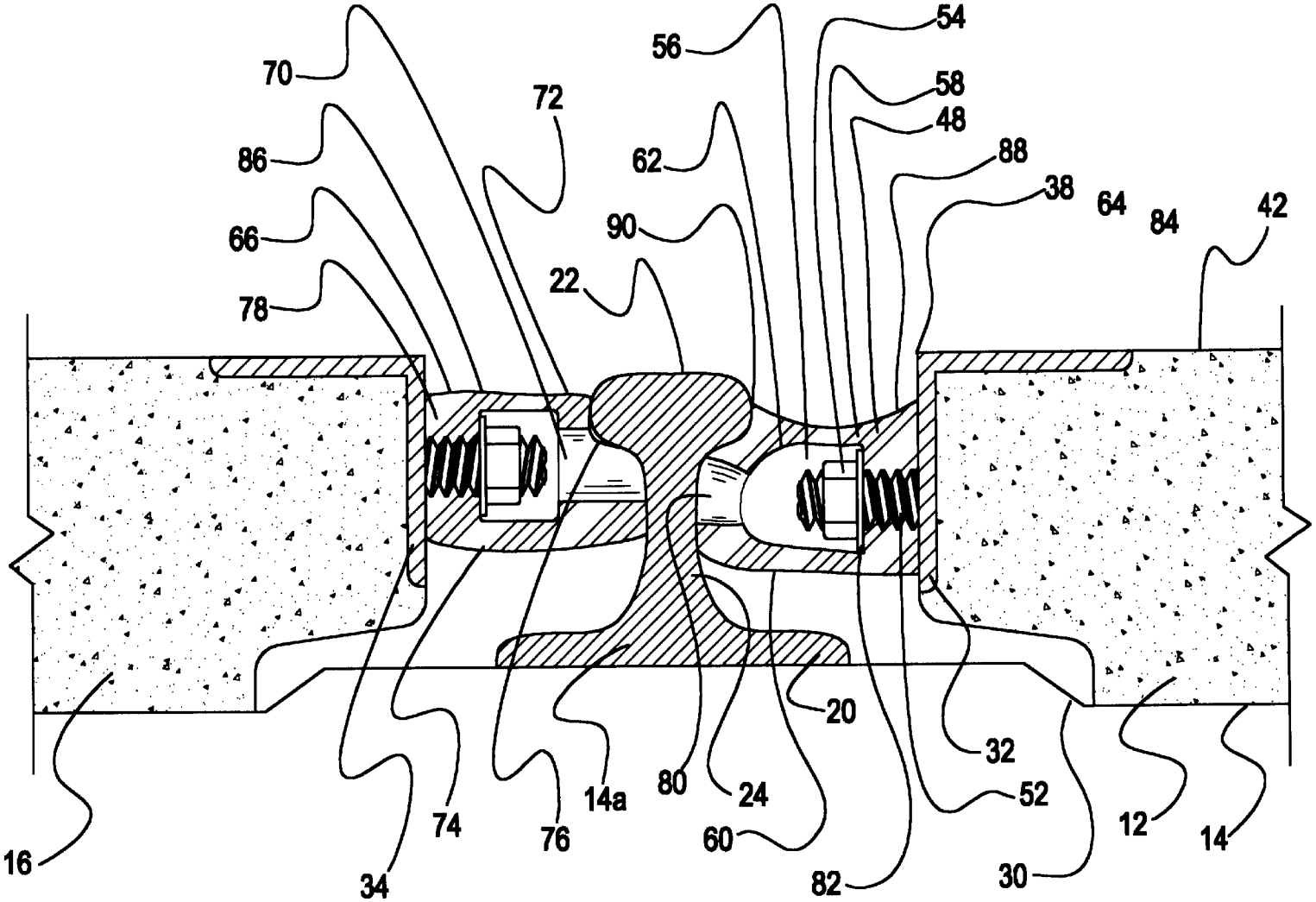
FIG. 2 is a partial sectional view of a preferred embodiment of the invention showing the engagement of a rail between a field and a gauge panel.
Figure 3:
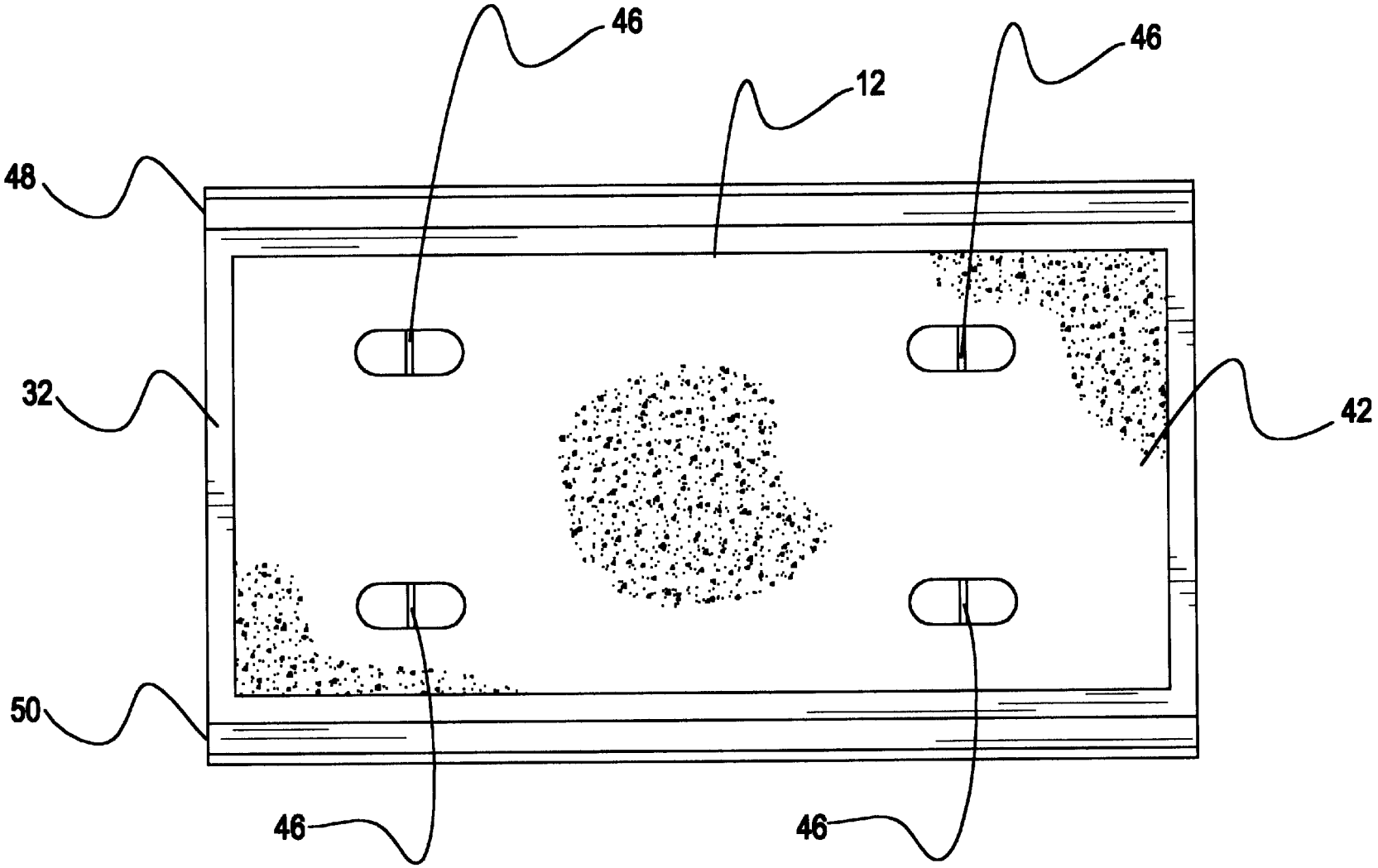
FIG. 3 is a top view of a preferred embodiment of a gauge panel of the invention.

With reference to the Drawings wherein like numerals represent like parts throughout the Figures, a preferred embodiment of the apparatus of the present invention is generally designated by numeral 10 in FIG. 1. For the sake of simplicity, the following description assumes the application of the present invention to a two rail railway, without limiting the applicability to multi-rail railways. Following the usual nomenclature, the area between the rails 14A and 14B is herein called the gauge, and both rails 14A and 14B comprise a relatively wide base section 20, an enlarged and thickened top section 22 for engaging the rail car wheels (not shown), and a web section 24 between the top and base sections 20 and 22, the web section 24 being thinner in cross-section than either the top 22 or base 20. The apparatus 10 of the present invention comprises at least one gauge panel 12 to fill the gap between rails 14A and 14B and two field panels 16 and 18, field panel 16 filling the gap between rail 14A and the abutment 26 of the crossing roadway and field panel 18 filling the gap between rail 14B and the opposing abutment 28 of the crossing roadway. Gauge panel 12 is generally flat and rectangular in shape with a width sized to fit between rails 14A and 14B and approximately as thick as the rails 14A and 14B are high above the railway bed 30. Field panels 16 and 18 are also both generally flat and rectangular in shape with a width determined by the space between rails 14A and 14B and the road abutments 26 and 28 and approximately as thick as the rails 14A and 14B are high above the railway bed 30. The gauge and field panels 12, 16 and 18 are formed of concrete, preferably precast concrete, and in the preferred embodiment, each has a steel frame, numerated in the Figures as 32, 34, and 36, respectively, alone the edges or the panels 12, 16, and 18. The gauge panel 12 has two parallel, rail facing sides 38 and 40, a flat top surface 42, and a bottom surface 44 that contacts the rail bed 30 when installed. The gauge panel bottom surface 44 is generally flat but may be contoured to conform to the commonly anticipated or encountered rail bed surfaces. At least two and preferably more cable attachment lugs 46 are embedded in the top surface 42 of the gauge panel 12 and at least one and preferably two lugs 46 are embedded in the top surface of the field panels 16 and 18, which lugs 46 are all recessed so as to not protrude. At least two of the cable attachment lugs 46 are laterally spaced toward the rail facing sides 38 and 40. The rail facing sides 38 and 40 are lined with resilient bumpers 48 and 50. Bumpers 48 and 50 are attached to the rail facing sides 38 and 40 respectively by means of bolt studs 52 and nuts 54. Each gauge panel bumper 48 and 50 is hollow, having a longitudinally extending central cavity 56 surrounded and formed by a top portion 58, a bottom portion 60, a rail side 62 and a gauge panel mounting side 64. Each field panel 16 and 18 is also lined with bumpers 66 and 68, which are similarly hollow and have a longitudinally extending central cavity 70 surrounded and formed by a top portion 72, a bottom portion 74, a rail side 76 and a field panel mounting side 78. The panel mounting bumper sides 64 and 78 are formed with a number of longitudinally spaced bolt holes 84 that are sized receive the bolt studs 52 and the longitudinal cavities 56 and 70 of both field panel bumpers 66 and 68 and gauge panel bumpers 48 and 50 are large enough to accommodate a nut 54 screwed onto the mounting bolts 52. An access opening 80 is formed in the rail side and partially in the top portion of each bumper in a size sufficient to receive a nut and nut turning device (not shown) such as a socket wrench or other similar device. A strap 82 formed of sheet metal with openings therein at the same intervals and the same size as the bolt studs 52 and bolt holes 84 is inserted into each bumper cavity, such that the mounting bolt studs 52 extend through the bolt holes 84 in the bumper and then through the strap 82 which serves distribute the retentive force of the nuts 54 which are threaded unto and tightened down on the mounting bolt studs 52. The outer surfaces of the rail sides 62 and 76 of both the gauge and field bumpers are contoured to closely conform to the side of the rail top portion 22 and the upper section of the rail web 24. In the preferred embodiment the field panel bumper top portion 72 has a flat upper surface 86, slightly lower than the surface of the field panel 16 or 18. The upper surface 88 of the gauge panel bumper top portion 58 is recessed to allow the flange of the rail car wheels to pass over the gauge panel bumper 48 and 50. An upward and outwardly protruding lip 90 is formed at the juncture of the top section 58 and the rail side 62 of the gauge panel bumpers 48 and 50, which lip 90 protrudes to the top of the rail 14A or 14B and extends the entire length of the gauge panel bumpers 48 and 50. The field panel bumpers 16 and 18 do not include such a lip. The longitudinal field bumper cavity 70 is only as large as is needed for the stabilizing strap 82 and mounting nuts 54. The gauge bumper cavity 56 has a relatively larger internal volume so that gauge bumpers 48 and 50 have increased compressibility and flexibility. The crossing device 10 is sized such that the field and gauge bumpers 66, 68, 48, and 50 snugly engage the rails 14A and 14B. Both field and gauge panel bumpers 66, 68, 48 and 50 are generally uniform in cross section and are formed of an elastomeric substance, preferably extruded styrene butadiene rubber of about 1200 psi tensile and 200% elongation, the gauge panel bumpers 48 and 50 having a 50 durometer resiliency and the field panel bumpers 66 and 68 having a 60 durometer resiliency.

Figure 4:
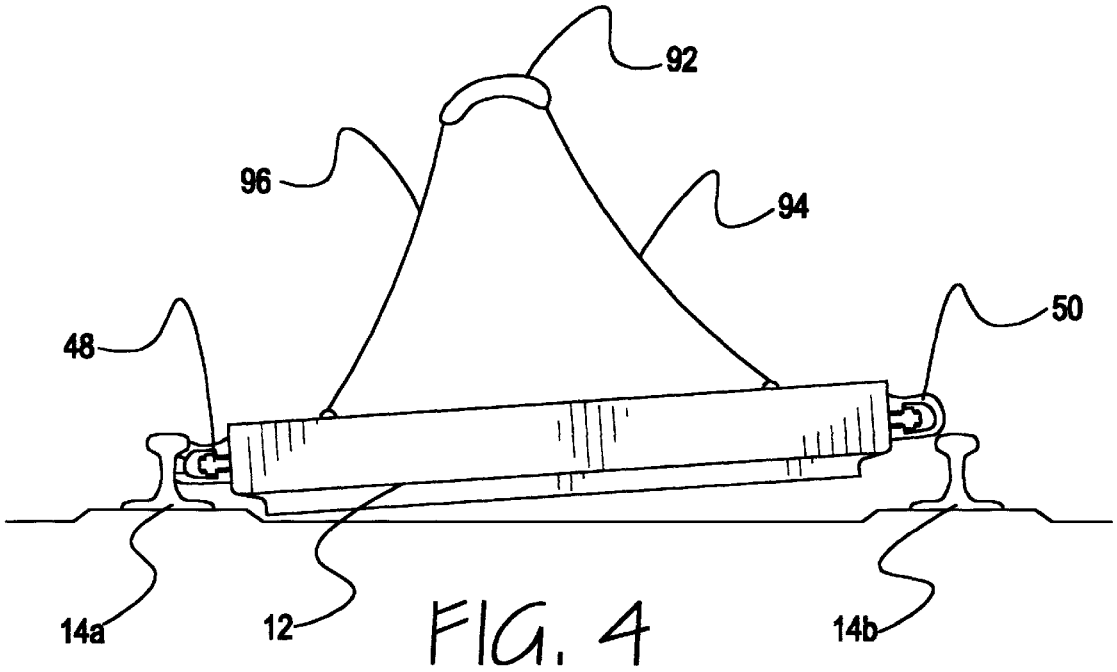
FIG. 4 is a side view of an initial step in the method of the present invention showing the installation of a gauge panel.
Figure 5:
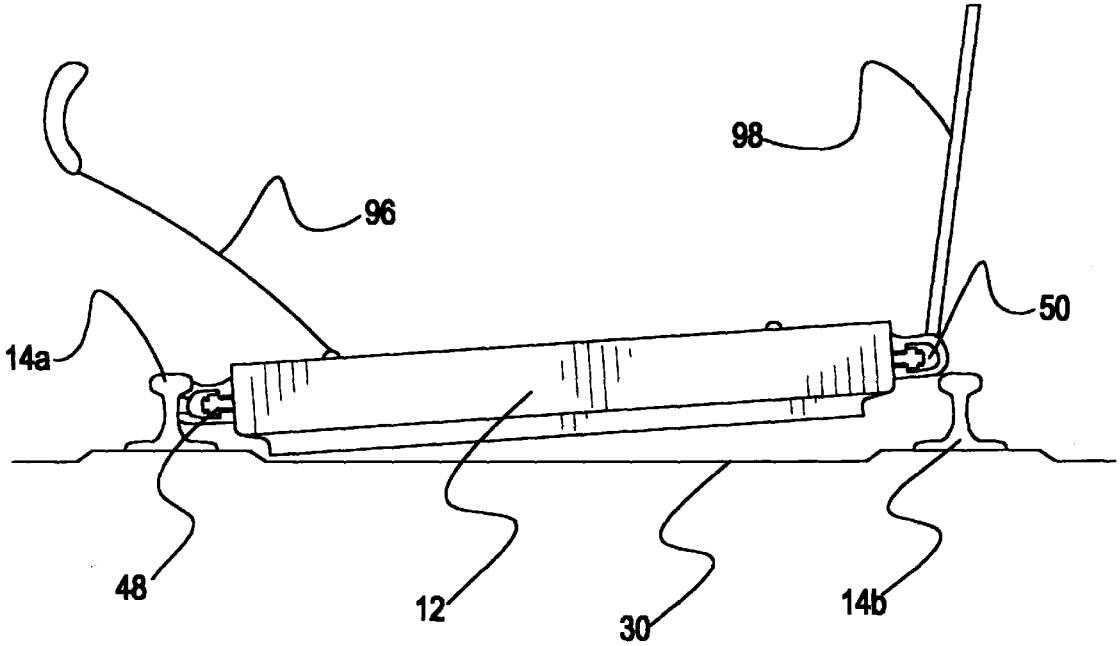
FIG. 5 is a side view of a second step in the method of the present invention showing the installation of a gauge panel.
Figure 6:
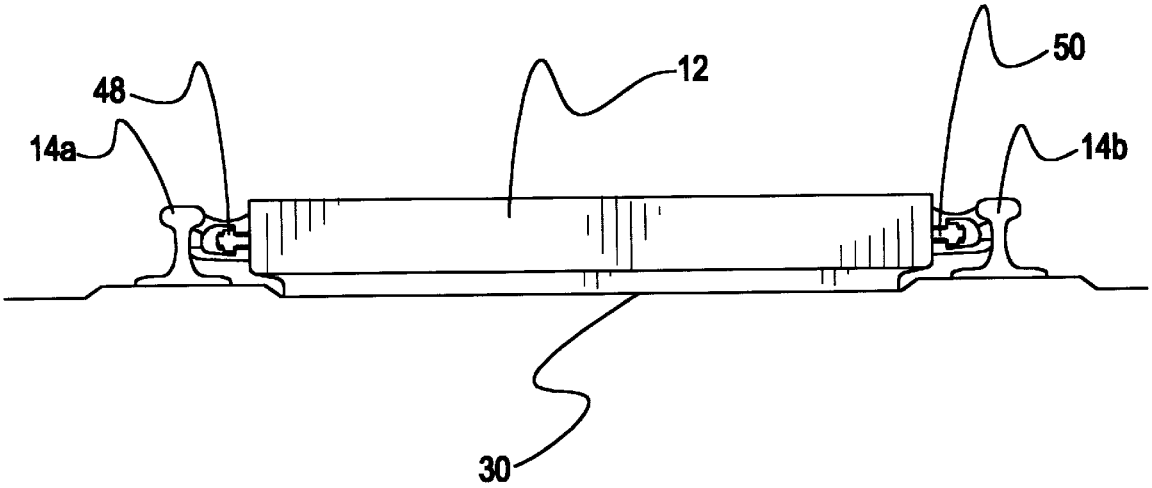
FIG. 6 is a side view of a third step in the method of the present invention showing the installation of a gauge panel.

The preferred installation method of the present invention is shown in FIGS. 4, 5, and 6. The installation of the gauge panel 12 between the rails 14A and 14B, commenced by fastening of a cable harness 92 to the attachment lugs 46 on the top surface 42 of the gauge panel 12 with near cables 94 attached to the lugs 46 closest to the crane and far cables 96 attached to the lugs 46 farthest from the crane. The gauge panel 12 is hoisted by the cable harness 92 attached to a backhoe, crane or other lifting device (not shown) that has been positioned generally normal to the railway, and the gauge panel 12 is lowered as shown in FIG. 4 to a point at which the bumper farthest from the lifting device, gauge panel bumper 48 can be engaged under the top section 22 of the rail farthest from the crane, rail 14A in the Drawings. The gauge panel 12 is lowered until the near bumper is resting on the near rail, at which point, the near cables 94 are released. The crane then moves toward far rail 14A, and pulls the gauge panel 12 toward far rail 14A, as shown in FIG. 5, compressing the engaged bumper 48 against the inside of the far rail 14A. A downward force is applied to gauge panel 12 and with prodding as required by a prodding tool 98, the near bumper 50 is urged passed the top section 22 of the near rail 14B. All cables 94 and 96 may then be released and the resiliency of the compressed gauge panel bumper 48 will cause gauge panel 12 to shift to the center of the gauge of the railway. A final step may be required to center the gauge panel 12 more exactly by reattaching cables 94 and 96 and lifting gauge panel 12 slightly to release the panel 12 from frictional contact with the railway bed 30 such that the equal resilience of the gauge panel bumpers 48 and 50 will cause the gauge panel 12 to be exactly centered between the two rails. Once the gauge panel 12 is placed in the desired position, the lifting device is lowered and the cables are disconnected. A similar method may be used to install the field panels 16 and 18 between the road abutments 26 and 28 and the outside of the rails 14A and 14B. A plurality of field and gauge panels may be used as required to achieve the desired width of crossing.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. In particular, it will be anticipated that a variety of means for attachment of the bumpers to the panels could be utilized and probably would be required for retro fit circumstances. It will be further anticipated that other materials could be used to form the bumpers, with substantially equivalent results so long as the physical characteristics of the substitute materials are similar, most specifically the resilience.

What is claimed is:

1. A railway crossing grade apparatus for installation at railroad crossings having road abutments, and at least one railroad track comprising a pair of parallel rails passing between the abutments, an outer abutment gap being defined between each rail and the adjacent abutment, a gauge gap being defined between the rails, each of said rails comprising a base with a web extending upwardly therefrom to a top section, the apparatus comprising:

A. at least one gauge panel for installation in the gauge gap, said gauge panel being generally rectangular in shape having opposite rail facing sides, a plurality of mounting bolts secured to said track facing sides, and means for securing panel lifting means;

B. a pair of elongated resilient bumpers each attached to a respective one of said opposite track facing sides of each gauge panel, the resilient bumpers being secured to said gauge panel by the mounting bolts;

C. at least one field panel for installation in each outer abutment gap, each field panel being generally rectangular in shape and having opposite rail and abutment facing sides and a plurality of mounting bolts secured to the rail facing side, and means for securing panel lifting means said; and D. an elongated resilient bumper attached to the rail facing side of each field panel, the resilient bumper being secured to the field panel rail facing sides by means of the mounting bolts.

2. The railway grade apparatus of claim 1, wherein the gauge and field panels are formed of precast concrete with a steel frame extending around the periphery of the panel.

3. The railway grade apparatus of claim 2, wherein the gauge and field panels and their respective bumpers are sized to be slightly wider than the gaps within which they are to be installed such that upon installation of each of said panels, a pressure engagement between the bumpers and adjacent rail is achieved.

4. The railway grade apparatus of claim 3 further comprising a plurality of securing nuts engageable with the mounting bolts, and wherein each bumper comprises a plurality of holes adapted for receiving the mounting bolts of said gauge and field panels such that the bumpers may be installed on the gauge and field panels by positioning the bumpers adjacent a rail facing panel side such that said bolts protrude through said holes, whereupon the securing nuts may be placed on said bolts to secure the bumper to the panel.

5. The railway grade apparatus of claim 4 further comprising a metal plate having holes therein corresponding to the mounting bolts and wherein each bumper comprises a cavity extending lengthwise through the bumper to receive the plate such that the mounting bolts protrude through the metal plate before engagement of the securing nuts.

6. The railway grade apparatus of claim 5 wherein the bumpers comprise rubber extrusions.

7. The railway grade apparatus of claim 6 wherein the bumpers comprise a contoured outer surface corresponding to the shape of the web and top sections of the facing rail, thereby achieving a substantially continuous contact therewith.

8. A method of installing a concrete panel at a railway grade crossing, the crossing having road abutments on either side of the crossing, at least one railroad track passing across and between said road abutments, the track comprising a pair of rails, an outer abutment gap being defined between each rail and the adjacent abutment, a gauge gap being defined between the rails, each of said rails comprising a base with a web extending upwardly therefrom to a top section, the installation method comprising:

A. providing at least one grade crossing gauge panel for installation within the gauge gap, each gauge panel having a pair of resilient bumpers attached to opposite sides thereof, each of said bumpers being adapted for pressure engagement with the rails, the gauge panel also having an attachment means for securing a lifting means to the top of the panel;

B. securing a means for lifting the gauge panel to the gauge panel;

C. lifting and positioning the gauge panel generally between the rails using the lifting means such that a first gauge panel bumpers is positioned in contact with the inside of one of said rails and wherein a second, opposite bumper is positioned generally atop the opposite rail;

D. exerting a lateral force on said gauge panel in the direction of the first bumper, thereby compressing the first bumper and permitting the other side of said panel to move downwardly, positioning the second bumper adjacent to the inside of the opposite rail; and E. releasing said lateral force on the panel, allowing it to assume an installed position with both bumpers in contact with each rail.

9. The method of claim 8 further comprising the step of exerting a downward force on the second bumper after application of said lateral force, urging the second bumper into place.

10. The method of claim 9 further comprising:

A. providing a plurality of attachment bolts;

B. securing the attachment bolts to opposite sides of the gauge panel;

C. providing a plurality of securing nuts adapted for engagement with the attachment bolts;

D. providing the pair of elongated resilient bumpers with a plurality of holes adapted for receiving the attachment bolts;

E. installing the pair of resilient bumpers on the gauge panel by positioning each bumper adjacent a respective one of the panel sides such that the attachment bolts protrude through the holes; and F. tightening the securing nuts on the attachment bolts.

11. The method of claim 10 wherein each bumper has a cavity extending lengthwise through the bumper and the method further comprises installing a metal plate with holes corresponding to the attachment bolts in position such that the attachment bolts protrude through the metal plate holes before engaging and tightening the nuts on the bolts.

12. The method of claim 11 further comprising a final step of lifting each panel enough to relieve friction between the bottom of the panel and the grade sufficiently to allow the resiliency of the compressed bump to adjust the panel position to relieve the bumper compression.

13. A method of installing a concrete panel at a railway grade crossing, the crossing having road abutments on either side of the crossing, at least one railroad track passing across and between said road abutments, the track comprising a pair of rails, an outer abutment gap being defined between each rail and the adjacent abutment, a gauge gap being defined between the rails, each of said rails comprising a base with a web extending upwardly therefrom to a top section, the installation method comprising:

A. providing at least one grade crossing gauge panel for installation within the gauge gap and at least one field panel for installation within each abutment gap, each gauge panel having a pair of resilient bumpers attached to opposite sides thereof and each field panel having one resilient bumper attached to one side, each of said bumpers being adapted for pressure engagement with the rails, the gauge and field panels also having an attachment means for securing a lifting means to the top of the panel;

B. securing a lifting device to the gauge panel;

C. lifting and positioning the gauge panel generally between the rails using the lifting device such that a first gauge panel bumper is positioned in contact with the inside of one of said rails and wherein a second, opposite bumper is positioned generally atop the opposite rail;

D. exerting a lateral force on said gauge panel in the direction of the first bumper, thereby compressing the first bumper and permitting the other side of said panel to move downwardly, positioning the second bumper adjacent to the inside of the opposite rail;

E. releasing said lateral force on the panel, allowing it to assume an installed position with both bumpers in contact with each rail;

F. securing a lifting device to a field panel;

G. lifting and positioning the field panel using the lifting device such that the field panel bumper is positioned in contact with the outside of a rail and the opposite side of the field panel is positioned generally atop the road abutment;

H. exerting a lateral force on the field panel in the direction of the bumper, thereby compressing the bumper against the rail and permitting the other side of said panel to move downwardly to a position adjacent to the road abutment;

I. releasing said lateral force on the field panel, allowing it to assume an installed position with the bumper in contact with the rail and the opposing side in contact with the road abutment; and J. repeating steps F through I to install the other field panel.

14. The method of claim 13 further comprising the step of exerting a downward force on the second gauge panel bumper after application of said lateral force, urging the second bumper into place.

15. The method of claim 14 further comprising:

A. providing a plurality of attachment bolts;

B. securing the attachment bolts to opposite sides of the gauge panel and one side of each field panel;

C. providing a plurality of securing nuts adapted for engagement with the attachment bolts;

D. providing the resilient bumpers with a plurality of holes adapted for receiving the attachment bolts;

E. installing the pair of resilient bumpers on the gauge panel by positioning each bumper adjacent a respective one of the panel sides such that the attachment bolts protrude through the holes and one bumper on each field panel in the same manner; and F. tightening the securing nuts on the attachment bolts.

16. The method of claim 15 wherein each bumper has a cavity extending lengthwise through the bumper and the method further comprises installing a metal plate with holes corresponding to the attachment bolts in position such that the attachment bolts protrude through the metal plate holes before engaging and tightening the nuts on the bolts.

17. The method of claim 16 further comprising a final step of lifting each panel enough to relieve friction between the bottom of the panel and the grade sufficiently to allow the resiliency of the compressed bump to adjust the panel position to relieve the bumper compression.

* * * * *